US005685438A

United States Patent [19]

Emanuel et al.

[11] Patent Number: 5,685,438

[45] Date of Patent: Nov. 11, 1997

[54] ERECTABLE HOLDER WITH OBJECT INSERTION HOLES

[75] Inventors: Janet Rettig Emanuel, New Haven; Robert W. Tamas, Stratford, both of Conn.

[73] Assignee: Simbiosys, Inc., New Haven, Conn.

[21] Appl. No.: 613,630

[22] Filed: Mar. 11, 1996

[51] Int. Cl.[6] ..... A47F 7/00

[52] U.S. Cl. ..... 211/70.1; 211/73; 206/486

[58] Field of Search ..... 211/60.1, 70.1, 211/73; 206/486, 443, 489, 382, 372, 341

[56] References Cited

U.S. PATENT DOCUMENTS

| | | | |
|---|---|---|---|
| 520,341 | 5/1894 | Sherman . | |
| 1,352,759 | 9/1920 | Markert . | |
| 1,836,138 | 12/1931 | Turner et al. . | |
| 2,333,715 | 11/1943 | Hahnemann | 211/70.1 X |
| 2,739,701 | 3/1956 | Sarvat et al. | 206/486 X |
| 3,083,824 | 4/1963 | Ness | 206/486 X |
| 3,115,247 | 12/1963 | Hauser | 206/486 X |
| 3,375,934 | 4/1968 | Bates . | |
| 3,390,783 | 7/1968 | Quackenbush, Jr. . | |
| 5,057,282 | 10/1991 | Linder . | |
| 5,080,232 | 1/1992 | Leoncavallo et al. . | |
| 5,373,939 | 12/1994 | Bloomqven | 211/70.1 X |

*Primary Examiner*—Robert W. Gibson, Jr.

*Attorney, Agent, or Firm*—McCormick, Paulding & Huber

[57] ABSTRACT

An inexpensive and expendable holder made of a single piece of flexible sheet material such as cardboard or plastic with object insertion openings for frictionally holding in place elongated objects such as test tubes. The insertion openings each comprise a pair of cross cuts penetrating through a top wall surface, and the orientation of immediately adjacent openings sharing a same row or column alternate between "crosses" and "exes" to maximize the number of openings per surface area of the receiving surface while maintaining the structural integrity of the surface. The holder preferably does not include a bottom wall, thereby minimizing the material and cost of the holder.

10 Claims, 3 Drawing Sheets

ERECTABLE HOLDER WITH OBJECT INSERTION HOLES

FIELD OF THE INVENTION

The invention concerns an inexpensive holder made of cardboard or other flexible sheet material, erectable from a flat condition to a usable condition to be used as a stand-alone unit or to be used and supported in its usable condition within an open-topped container, with object insertion holes for firmly holding in place objects, preferably objects of any cylindrical or conical shape, such as tubes or vials of similar or variable size during handling, transport, cryostorage or general use in various fields including chemical, biochemical or molecular biological laboratory settings, and deals more particularly with improvements in such a holder.

BACKGROUND OF THE INVENTION

Holders of the general type in question are known from U.S. Pat. No. 520,341. One of the holders shown by this patent is a box made from folded flexible sheet material and having a latticed insert which forms a plurality of rectangular compartments for receiving objects such as eggs and for separating them from one another. A disadvantage of this holder is that loosely fit objects can move around within the individual compartments or even fall out when the box is jostled or tipped or turned upside down. On the other hand, tightly fit objects can make it difficult to grasp and remove the objects. For example, if the received objects are test tubes tightly fitting into the compartments and having large diameter snap or screw caps it may be hard for a person to get a good grip on any one of the test tubes to withdraw it from the holder.

Another holder of U.S. Pat. No. 520,341 is a box made of folded flexible material and having an elevated horizontal top wall with a plurality of object receiving openings in the top wall each defined by a pair of cross cuts perpendicular to one another forming four lips deflectable downwardly from the remainder of the top wall when an object is inserted into the hole. The four lips resiliently engage the inserted object to hold it in place relative to the top wall and to suit the size of the opening to the size of the object. A drawback of this holder is that the top wall is weakened due to the ends of adjacent pairs of cross cuts being relatively close to one another so that the top wall may tend to tear when objects are inserted into its holes. A solution to strengthening the top wall is to increase the distance between adjacent pairs of cross cuts. However, increasing such distance requires increasing the area of the top wall, thereby increasing the cost and size of the holder. Another disadvantage is that the box includes a bottom wall located below the top wall, which bottom wall may not be necessary for many applications of the holder and which therefore unnecessarily adds to the material requirement and cost of the holder.

SUMMARY OF THE INVENTION

The invention has as its object the provision of an inexpensive or expendable object holder, made essentially of flexible cardboard, sheet plastic or the like, that can be stored and shipped in a flat condition and then erected to a usable form in which it is stable on a shelf, tabletop or other horizontal supporting surface or may be supported and maintained in its usable form within an open-top container and has a horizontal top wall elevated above the supporting surface, with a plurality of openings for receiving and resiliently gripping objects inserted into the openings, the openings being so formed in the top wall that they may be relatively closely spaced to one another without unduly weakening the top wall.

The invention resides in that the holder is formed from a single piece of sheet material cut and foldable in such a way that when in its erected condition as a stand-alone unit it comprises essentially a top wall and a side wall or walls extending downwardly from the top wall, which side wall or walls is or are engageable directly with a supporting surface to hold the top wall in an elevated state above and parallel to the supporting surface without the holder including any bottom wall. Alternatively, the holder may be supported and maintained in its erected condition by being positioned within an open-top container having one or more containment walls, whereby the one or more containment walls of the container prevent the side wall or walls of the holder from collapsing outwardly. The side wall or walls of the holder is or are adjacent to or engageable directly with a base of the open-top container which serves as a supporting surface.

The invention also resides in the top wall of the holder having object receiving openings each formed by a pair of cross cuts generally perpendicular to one another and with at least some of the openings being arranged in rows and columns, the cross cuts of adjacent openings being so oriented relative to one another that neither of the two cuts forming one opening are aligned with either of the two cuts forming an immediately adjacent opening.

More particularly, the invention resides in each opening formed in the top wall being either in the form of an "X" or a "cross", with an "X" opening being one in which the two cross cuts defining it are inclined to a straight reference line, such as one of the side edges of the top wall in the case of the top wall being rectangular, and fixed relative to the top wall, and with a "cross" opening being one in which the two cross cuts defining it are perpendicular and parallel respectively to the reference line; and at least some of the openings are so arranged in rows and columns that the "X" openings and "cross" openings alternate with one another both in the rows and columns, thereby avoiding the end of one cut being located very close to the end of another cut even though the openings may be spaced relatively closely to one another in the rows and columns.

DETAILED DESCRIPTION OF THE PREFERRED EMBODIMENTS

Figure 2:
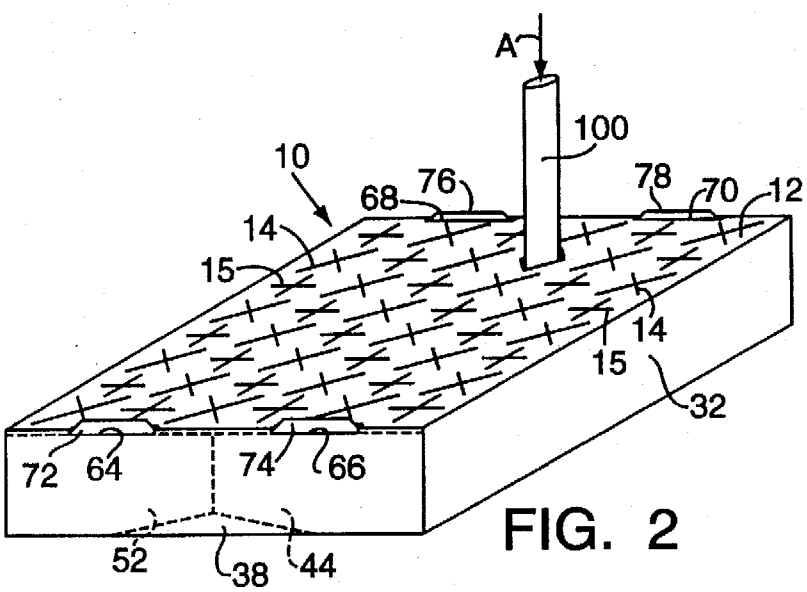
FIG. 2 is a top perspective view showing the holder of FIG. 1 in its erected condition.
Figure 3:
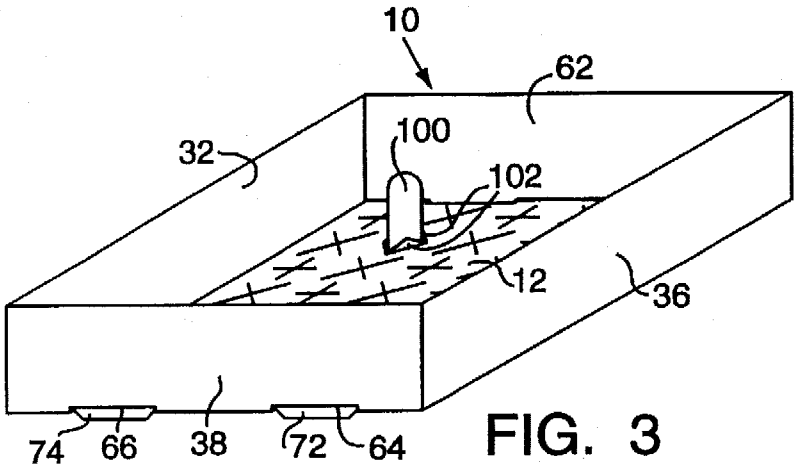
FIG. 3 is a bottom perspective view showing the holder of FIG. 1 in its erected condition.
Figure 1:
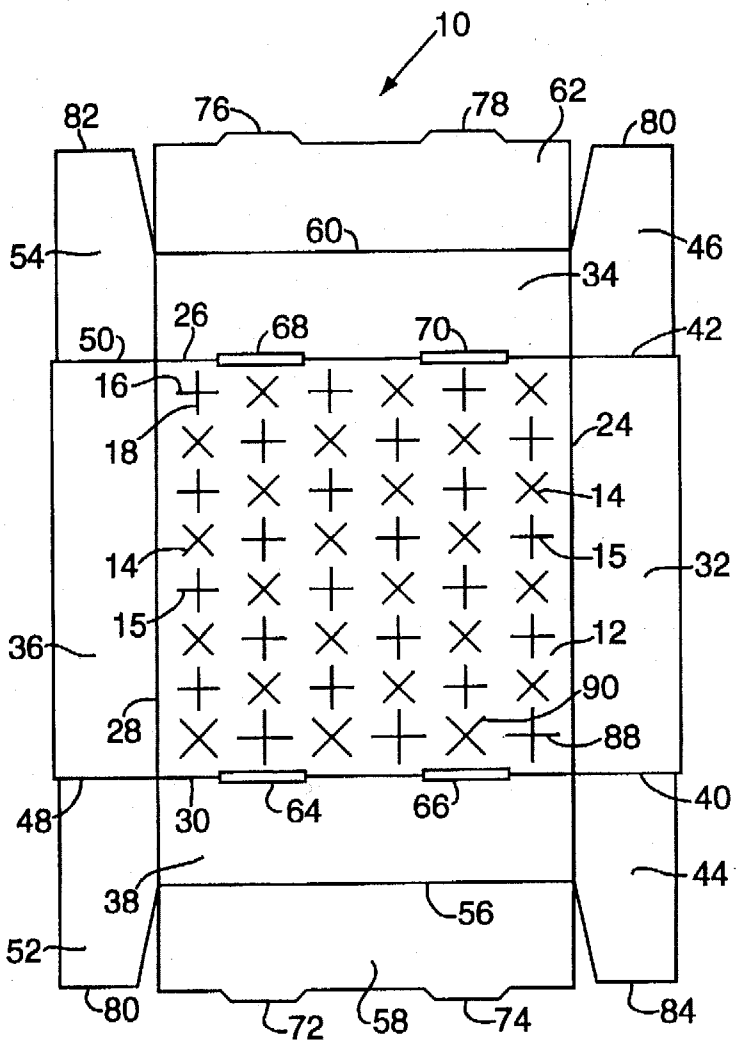
FIG. 1 is a plan view illustrating a preferred embodiment of the holder in its flat, unerected condition.

A preferred embodiment of the inexpensive or expendable object holder of this invention used as a stand-alone unit is indicated generally at 10 in FIG. 1 in its flat, unerected condition. The holder 10 is made of a single piece of cardboard or other flexible and disposable sheet material, erectable from a flat condition to a usable condition, as shown in FIGS. 2 and 3, in which it is stable on a shelf, tabletop or other horizontal supporting surface. Preferably, the cardboard or other sheet material is sufficiently absorbent as a means for containing contaminants such as chemical, radioactive or biological contaminants. The top wall 12 has a plurality of openings 14 and 15 for receiving and resiliently gripping objects of similar or variable size inserted into the openings during handling, transport, cryostorage or general use in various fields including chemical, biochemical or molecular biological laboratory settings. Preferably, the holder accepts any cylindrical or conical objects such as tubes, vials, lipstick cases, and tools, particularly where the top of the object is larger than its bottom because of, for example, an object lid or closure. The openings are so formed in the top wall 12 that they may be relatively closely spaced to one another without unduly weakening the top wall. As illustrated in FIG. 1, the object holder 10 is flat when unassembled so that the holders take up a minimum of space for easy packaging and shipping in bulk prior to use and for easy disposal after use.

The object receiving openings are each formed by a pair of cross cuts, such as cross cuts 16 and 18, generally perpendicular to one another, and the openings are arranged in rows and columns. Any one opening 14 or 15 is located in a given row and column, and "immediately adjacent" openings are ones which are adjacent to it and share the same row or column. The cross cuts of these immediately adjacent openings are so oriented relative to those of the one opening that neither of the two cuts of the one opening are aligned with either of the two cuts of any of the openings immediately adjacent to it. More particularly, each opening formed in the top wall 12 is either in the form of an "X", such as the openings 14, or a "cross", such as the openings 15, with an "X" opening being one in which the two cross cuts defining it are inclined at an angle of about 45', to a straight reference line, such as one of the side edges 24 of the illustrated top wall 12, fixed relative to the top wall, and with a "cross" opening being one in which the two cross cuts defining it are perpendicular and parallel respectively to the reference line. The openings are so arranged in the rows and columns that the "X" openings and the "cross" openings alternate with one another both in the rows and in the columns, thereby avoiding the end of one cut of an opening being located very close to the end of a cut of an immediately adjacent opening in a same row or column even though the openings may be spaced relatively closely to one another in the rows and columns. Thus, the alternating configuration of "x's" and "crosses" between immediately adjacent openings minimizes the danger of tearing the top wall when objects are inserted into the openings and maximizes the number of openings that can be safely incorporated in a particular top wall surface area without harming its structural integrity. As a result, the material requirement and cost of the holder is minimized as compared to other holders using cross cuts of non-alternating orientation for object openings.

Creases 24, 26, 28 and 30 separate the top wall 12 from respective sidewalls 32, 34, 36 and 38. Creases 40 and 42 separate the sidewall 32 from respective stability flaps 44 and 46, and creases 48 and 50 separate the sidewall 36 from respective stability flaps 52 and 54. Crease 56 separates the sidewall 38 from a double-back flap 58, and crease 60 separates the sidewall 34 from a double-back flap 62. Slits 64 and 66 intersect the crease 30, and slits 68 and 70 intersect the crease 26. Tabs 72 and 74 extend outwardly from the double-back flap 58, and tabs 76 and 78 extend outwardly from the double-back flap 62.

The holder 10 is erected from the flat condition of FIG. 1 by first bending the sidewalls 32 and 36 at the respective creases 24 and 28 so that these sidewalls extend downwardly from the horizontal top wall 12 in planes perpendicular to the plane of FIG. 1. Next, the stability flaps 46 and 54 are folded inwardly toward each other at respective creases 42 and 50 to form right angles to the respective sidewalls 32 and 36 so that ends 80 and 82 of the respective stability flaps 46 and 54 are adjacent to one another and the stability flaps extend downwardly in a plane cutting through the crease 26 and perpendicular to the plane formed by FIG. 1. Likewise the stability flaps 44 and 52 are folded inwardly toward each other at respective creases 40 and 48 to form right angles to the respective sidewalls 32 and 36 so that ends 84 and 86 of the respective stability flaps 44 and 52 are adjacent to one another and the stability flaps extend downwardly in a plane cutting through the crease 30 and perpendicular to the plane formed by FIG. 1. The sidewall 34 is next folded downwardly at the crease 26 to abut the stability flaps 46 and 54. Likewise the sidewall 38 is folded downwardly at the crease 30 to abut the stability flaps 44 and 52. The double-back flap 62 is folded 180° at the crease 60 around and surrounding the stability flaps 46 and 54 to sandwich the flaps between the sidewall 34 and the double-back flap 62, thereby keeping the flaps in position. The tabs 76 and 78 are then inserted into the respective slots 68 and 70 to lock the double-back flap 62 in place. Similarly, the double-back flap 58 is folded 180° at the crease 56 around and surrounding the stability flaps 44 and 52 to sandwich the flaps between the sidewall 38 and the double-back flap 58, thereby keeping the flaps in position. The tabs 72 and 74 are then inserted into the respective slots 64 and 66 to lock the double-back flap 58 in place. As can be seen in FIGS. 1 and 3, a bottom wall is not provided, and this further minimizes the amount of material required and the cost of the holder 10.

FIG. 2 is a top perspective view of the holder 10 of FIG. 1 in its erected condition with a test tube 100 inserted through one of its openings in the top wall 12. The test tube is inserted by moving it downwardly relative to the holder in the direction denoted by arrow A. FIG. 3 is a bottom perspective view of the holder 10 of FIG. 2. As can be best seen in FIGS. 2 and 3, the test tube 100 deflects the object receiving wall downwardly in the vicinity of the opening to form four lips 102 (only three lips being visible in FIG. 3) resiliently gripping the test tube. One advantage of the lips is that they resiliently press snugly and uniformly around test tubes or other inserted objects having a range of different diameters so as to frictionally hold them in place when the holder is jostled or tipped or turned upside down. That is, a single opening can acceptably accommodate objects of different size.

The arrangement of the openings in the top wall and their sizes may be varied to suit the particular intended applications of the holder. That is, in the case of some holders there may be only one row of openings, and in the case of other holders not all of the openings may be strictly arranged in rows and columns, and the openings may be of different size. For example, in the holder 10 of FIGS. 1 to 3 the illustrated openings 88 and 90 of one row are larger as compared to the openings 14 and 15 of other rows so as to be able to receive and resiliently grip relatively larger-sized objects.

Figure 4:
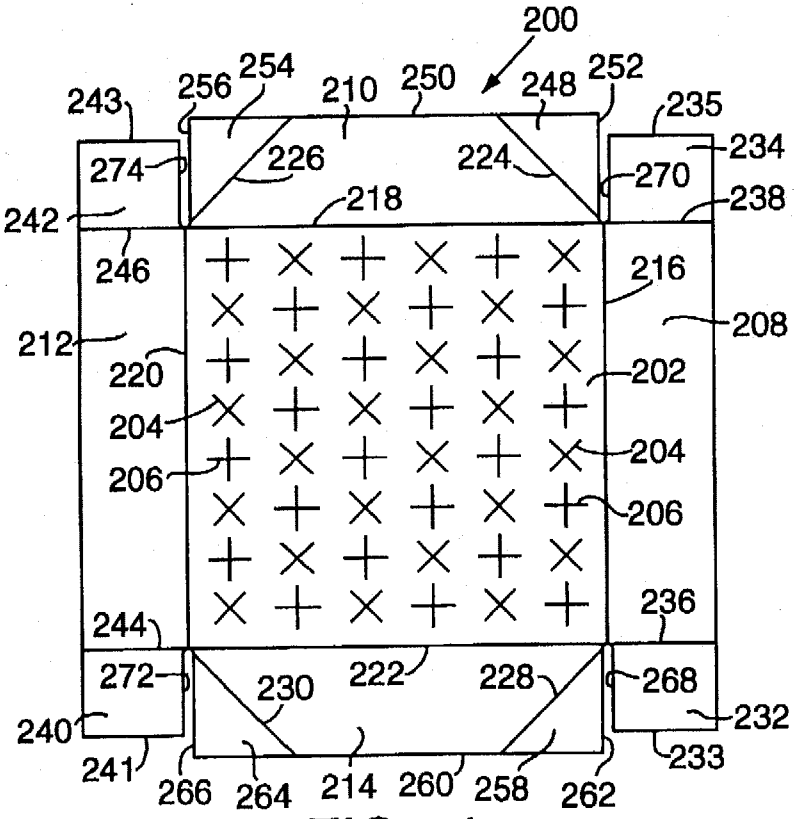
FIG. 4 is a plan view illustrating a blank from which a holder comprising another preferred embodiment may be made.

FIG. 4 illustrates a blank indicated generally at 200 from which a holder can be constructed according to a second preferred embodiment of this invention. A top wall 202, which is to be parallel to and elevated relative to a horizontal supporting surface when the holder is erected, has rows and columns of object receiving openings in the form of "X" openings 204 which alternate in orientation with "cross" openings 206 to provide a maximum number of openings per surface area of the top wall while maintaining good structural integrity of the wall. The top wall 202 is separated from sidewalls 208, 210, 212 and 214 by respective creases 216, 218, 220 and 222. The sidewall 210 includes diagonally extending creases 224 and 226. Likewise, the sidewall 214 includes diagonally extending creases 228 and 230. Stability flaps 232 and 234 are separated from the sidewall 208 by respective creases 236 and 238. Stability flaps 240 and 242 are separated from the sidewall 212 by respective creases 244 and 246. A first triangular portion 248 is formed in the sidewall 210 and is bordered by the crease 224 and edges 250 and 252 of the sidewall 210. A second triangular portion 254 is formed in the sidewall 210 and is bordered by the crease 226 and edges 250 and 256 of the sidewall 210. A third triangular portion 258 is formed in the sidewall 214 and is bordered by the crease 228 and edges 260 and 262 of the sidewall 214. Finally, a fourth triangular portion 264 is formed in the sidewall 214 and is bordered by the crease 230 and edges 260 and 266 of the sidewall 214.

Figure 5:
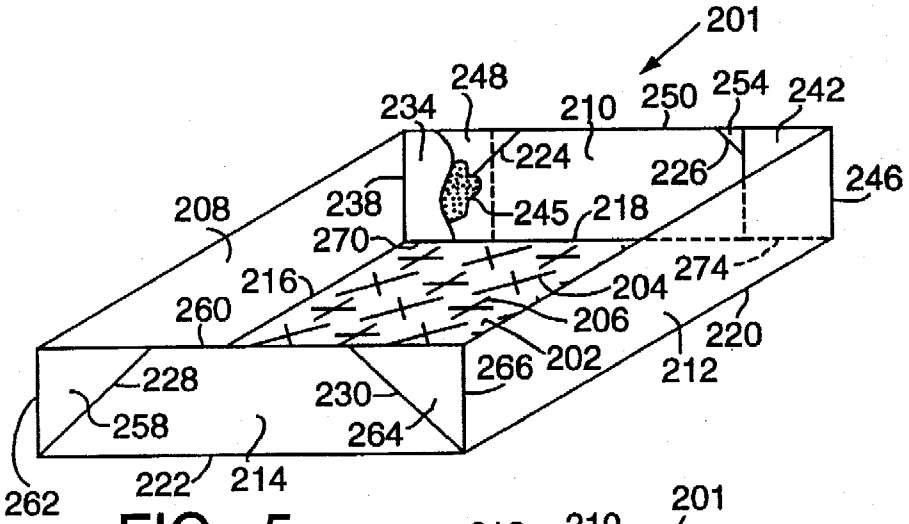
FIG. 5 is a bottom perspective view showing a holder in its erected condition and formed from the blank of FIG. 4, with one of the stability flaps being shown partially broken away to reveal the spot of glue used to attach it to the associated triangular portion of its adjacent sidewall.
Figure 6:
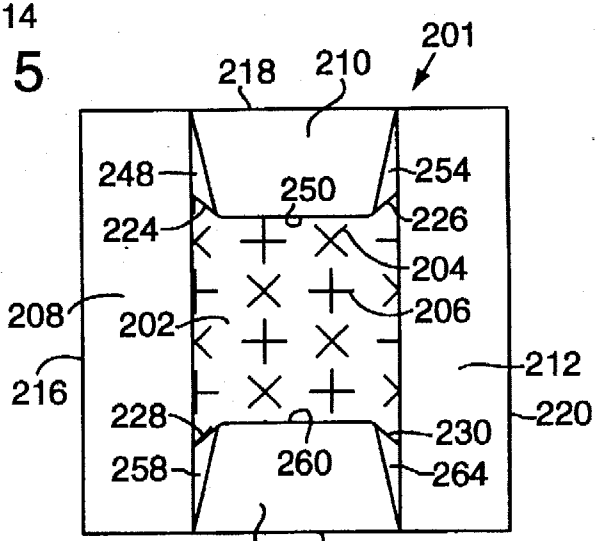
FIG. 6 is a bottom plan view of the holder of FIG. 5 in a flattened condition.

FIGS. 5 and 6 illustrate a bottom perspective view and a bottom plan view respectively of a holder 201 formed from the blank 200 of FIG. 4, with FIG. 6 showing the holder in its flattened condition and with FIG. 5 showing it in its erected condition. Elements of FIGS. 5 and 6 that are the same as those shown in FIG. 4 are denoted by like reference numerals.

Referring to FIG. 4, the blank 200 is made into the holder 201 of FIG. 5 by first bending the sidewalls 208 and 212 at the respective creases 216 and 220 so that these sidewalls extend downwardly from the horizontal top wall 202 in planes perpendicular to the plane of FIG. 4. Next, the stability flaps 234 and 242 are folded inwardly toward each other at respective creases 238 and 246 to form right angles to the respective sidewalls 208 and 212 so that ends 235 and 243 of the respective stability flaps 234 and 242 are adjacent to one another and the stability flaps extend downwardly in a plane cutting through the crease 218 and perpendicular to the plane formed by FIG. 4. Likewise, the stability flaps 232 and 240 are folded inwardly toward each other at creases 236 and 244 to form right angles to the respective sidewalls 208 and 212 so that ends 233 and 241 of the respective stability flaps 232 and 240 are adjacent to one another and the stability flaps extend downwardly in a plane cutting through the crease 222 and perpendicular to the plane formed by FIG. 4. The sidewall 210 is next folded downwardly at the crease 218 to abut the stability flaps 234 and 242. Likewise the sidewall 214 is folded downwardly at the crease 222 to abut the stability flaps 232 and 240. Each of the sidewall triangular portions 248, 254, 258 and 264 is then attached to the abutting portion of the respectively associated stability flap 234, 242, 232 or 240 by suitable means such as a spot of glue as shown at 245 in FIG. 5. The stability flaps 232, 234, 240 and 242 have respective edges 268, 270, 272 and 274 which are angled relative to the plane formed by the top wall 202. The angled edges 268, 270, 272 and 274 press firmly against the top wall to strengthen the stability of the holder 201 when in its erected condition. The holder does not include a bottom wall and thereby the material requirement and cost of the holder is minimized.

As shown in FIG. 6, the holder can be collapsed from its erected condition into a substantially two-dimensional flattened condition for ease of storage or disposal by pressing inwardly on the diagonal creases 224, 226, 228 and 230 which causes the sidewalls 208, 210, 212 and 214 to fold inwardly and abut an inner surface of the top wall 202. From its flattened condition the holder can be erected by first pulling up the sidewalls 210 and 214 and then pushing outwardly on the creases 224, 226, 228 and 230.

Figure 7:
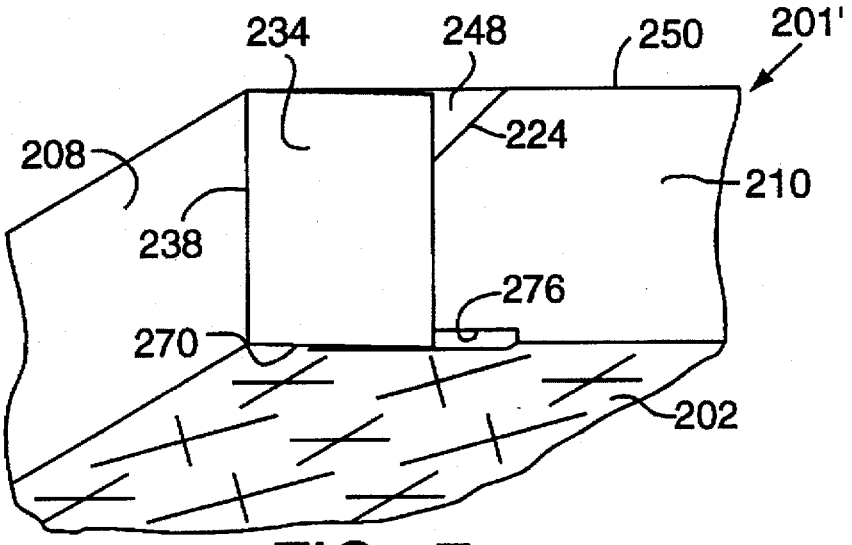
FIG. 7 is a fragmented bottom perspective view of a modification of the holder of FIG. 5.

FIG. 7 illustrates a modified version 201' of the holder 201 of FIG. 5. The illustrated upper left corner of the holder 201' has an added slit 276 to receive and hold the edge 270 of the stability flap 234 to provide further stability to the holder 201' when in its erected condition. Of course, the other three stability flaps of the holder 201' also cooperate with similar slits (not shown) in their associated portions of the top wall.

Figure 8:
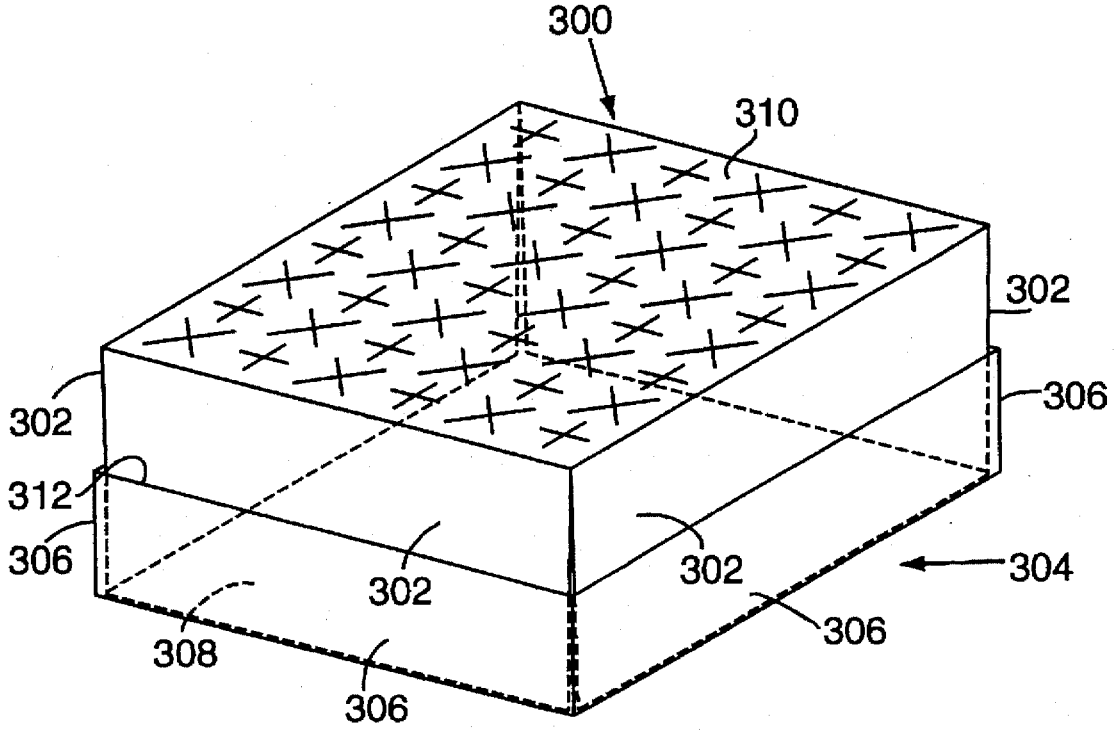
FIG. 8 is a top perspective view showing a holder comprising another preferred embodiment supported within an open-top container.

FIG. 8 illustrates a holder indicated generally at 300 and having one or more sidewalls 302, 302 according to a third preferred embodiment of this invention. The holder 300 is supported and maintained in its erected condition by being positioned within an open-top container 304 having one or more containment walls 306, 306 and a base 308. Specifically with respect to FIG. 8, four containment walls 306, 306 of the container 304 cooperate with one another to substantially surround four side walls 302, 302 of the holder 300, whereby the containment walls 306, 306 prevent the side walls 302, 302 of the holder 300 from collapsing outwardly into the holder's flat, unerected condition.

The side walls 302, 302 of the holder 300 are adjacent to or engageable directly with the base 308 of the open-top container which serves as a supporting surface. For the purpose of clearly showing the side walls 302, 302, the height of the side walls is about twice the height of the containment walls 306, 306. As such, a top wall 310 of the holder 300 is positioned well above a top perimeter surface 312 of the container 304. However, the relative heights of the holder side walls 302, 302 and the container containment walls 306, 306 may be adjusted such that the top wall 310 is positioned at various heights either above or below the top perimeter surface 312 of the container 304.

As can be seen in FIG. 8, the containment walls 306, 306 eliminate the need for stability flaps to be formed in the holder 300 to maintain the holder in an erected condition, thereby simplifying the holder's complexity both as to the number of construction components and as to the number of assembly steps. For example, as can be seen in FIG. 8, the assembly process of the holder 300 merely entails folding the side walls 302, 302 downwardly and perpendicularly relative to the top wall 310, and inserting the holder within the container 304.

The previously described embodiments represent only examples which in no way limit the invention claimed by the claims. For example, the holder can be made of any relatively inexpensive and flexible material. Furthermore, the holder can be made flexible by means other than creases, such as by perforations. Therefore, the invention has been described in preferred embodiments by way of illustration rather than limitation.

We claim:

1. An object holder made from flexible sheet material and which can be transformed from a flat condition to an erected condition on a horizontal supporting surface and useful for receiving and holding objects, said holder comprising:

a horizontal top wall having a plurality of openings for receiving and resiliently gripping objects inserted into the openings, said openings each comprising a pair of cross cuts generally perpendicular to one another, at least some of said openings being arranged in a row, the cross cuts of said openings included in said row being so oriented that neither of the two cuts forming one of said openings of said row are aligned with either of the two cuts forming an opening in said row and located immediately adjacent said one opening; and one or more sidewalls attached to said top wall so as to extend vertically downwardly from the perimeter of said top wall when said holder is in its erected condition and to be engageable with a horizontal supporting surface to hold said top wall in a position elevated from and parallel to such supporting surface.

2. An object holder made from flexible sheet material and which can be transformed from a flat condition to an erected condition on a horizontal supporting surface and useful for receiving and holding objects, said holder comprising:

a horizontally top wall having a plurality of openings for receiving and resiliently gripping objects inserted into the openings, said openings each comprising a pair of cross cuts generally perpendicular to one another, at least some of said openings being arranged in a row, the cross cuts of said openings included in said row being so oriented that neither of the two cuts forming one of said openings of said row are aligned with either of the two cuts forming an opening in said row and located immediately adjacent said one opening; and one or more sidewalls attached to said too wall so as to extend vertically downwardly from the perimeter of said top wall when said holder is in its erected condition and to be engageable with a horizontal supporting surface to hold said top wall in a position elevated from and parallel to such supporting surface, each of said one or more sidewalls having a free bottom edge engageable with a horizontal supporting surface so that said holder when placed in erected condition on such supporting surface has said top wall thereof directly exposed to said supporting surface.

3. An object holder according to claim 1, wherein at least some of said plurality of openings are arranged in a plurality of rows and columns, the two cross cuts of any one of said openings in said rows and columns being out of alignment with all of the cuts forming openings immediately adjacent said one opening and located in the same row or column as occupied by said one opening.

4. An object holder according to claim 1, wherein pairs of cross cuts are of different lengths with respect to other pairs of cuts.

5. An object holder according to claim 1, wherein the sidewalls are flexibly attached to the top wall by means of creases.

6. An object holder according to claim 1, wherein the holder is made from cardboard.

7. An object holder according to claim 1, wherein the holder is made from a flexible plastic material.

8. An object holder according to claim 1, wherein said pair of cross cuts forming each opening are in the form of either an "ex" or a "cross", an "X" opening being one in which the cross cuts defining it are inclined at an angle of about 45° to a straight reference line fixed relative to said top wall, a "cross" opening being one in which the cross cuts defining it are perpendicular and parallel respectively to said reference line, and the openings are so arranged in rows and columns that the "X" openings and "cross" openings alternate with one another both in said rows and in said columns.

9. An object holder according to claim 1, wherein said one or more sidewalls extends or extend substantially continuously around the perimeter of said top wall.

10. An object holder made from a single piece of flexible sheet material that can be assembled from a flat condition to an erected condition on a horizontal supporting surface for storing and transporting objects such as test tubes, said holder comprising:

a horizontal top wall having a plurality of openings arranged in rows and columns for receiving and resiliently gripping objects inserted into the openings, said openings each comprising a pair of cross cuts generally perpendicular to one another, the cross cuts of immediately adjacent openings sharing the same row or column being so oriented that cross cuts of immediately adjacent openings are in the form of either an "X" or a "cross", an "X" opening being one in which the cross cuts defining it are inclined to a straight reference line fixed with respect to said top wall, a "cross" opening being one in which the cross cuts defining it are perpendicular and parallel respectively to the reference line, and the openings are so arranged in rows and columns that the "X" openings and "cross" openings alternate with one another both in the rows and columns, said top wall being of rectangular shape and having four side edges; and four sidewalls attached respectively to said four side edges of said top wall so as to extend vertically downwardly from the perimeter of said top wall when said holder is in its erected condition to hold said top wall in an elevated position and parallel to a horizontal supporting surface onto which said holder may be placed, said sidewalls having free bottom edges so that said top wall is exposed to the supporting surface over which said holder is placed.

* * * * *